US011525444B2

(12) United States Patent
Claywell et al.

(10) Patent No.: US 11,525,444 B2
(45) Date of Patent: Dec. 13, 2022

(54) SCAVENGE GEAR PLATE FOR IMPROVED FLOW

(71) Applicant: GM Global Technology Operations LLC, Detroit, MI (US)

(72) Inventors: Mark R. Claywell, Birmingham, MI (US); Sean M. McGowan, Northville, MI (US); Chung Y. Wei, Rochester Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/038,245

(22) Filed: Sep. 30, 2020

(65) Prior Publication Data

US 2022/0099090 A1 Mar. 31, 2022

(51) Int. Cl.
*F04C 15/06* (2006.01)
*F04C 2/18* (2006.01)

(52) U.S. Cl.
CPC ..... *F04C 15/06* (2013.01); *F04C 2/18* (2013.01); *F04C 2210/14* (2013.01); *F04C 2210/206* (2013.01); *F04C 2240/801* (2013.01)

(58) Field of Classification Search
CPC ..... F04C 15/06; F04C 2/18; F04C 2210/206; F04C 2210/14; F04C 2240/801; F04C 11/001; F04C 11/003; F04C 11/008
See application file for complete search history.

(56) References Cited

U.S. PATENT DOCUMENTS 1,723,493 A * 8/1929 Schotthoefer ..... F04C 15/00 417/428
4,090,820 A * 5/1978 Teruyama ..... F04C 15/0088 418/79
5,755,566 A * 5/1998 Marsillo ..... F04C 2/123 418/200
6,135,741 A * 10/2000 Oehman, Jr. ..... F04C 15/0026 418/206.8
6,390,793 B1 * 5/2002 Sweet ..... F04C 15/0026 418/132
8,287,255 B2 * 10/2012 Yokoi ..... F04C 11/001 417/426
8,496,457 B2 * 7/2013 Varga ..... F04C 2/18 418/200
10,982,670 B2 * 4/2021 Claywell ..... F04C 11/001
2006/0257267 A1 * 11/2006 Weiss ..... F04C 2/18 417/199.1
2007/0248480 A1 * 10/2007 Mayer ..... F04C 11/001 418/206.1
2017/0107872 A1 * 4/2017 McGowan ..... F01M 1/12
2020/0232458 A1 * 7/2020 Claywell ..... F04C 2/18

FOREIGN PATENT DOCUMENTS

DE 102012216122 A1 * 4/2013 ..... F04C 2/084

OTHER PUBLICATIONS

English Machine Translation of DE102012216122A1 (translated by Espacenet on Sep. 12. 2021) (Year: 2013).*

* cited by examiner

*Primary Examiner* — Dominick L Plakkoottam
*Assistant Examiner* — Paul W Thiede
(74) *Attorney, Agent, or Firm* — Vivacqua Crane PLLC

(57) ABSTRACT

A pump includes a first gear plate and a first pair of counter rotating gears positioned on a first side of the gear plate. The pair of counter rotating gears draws fluid from an inlet and transfers the fluid into an outlet of a common manifold. The gear plate has a cutout to increase the flow of fluid into the common manifold.

9 Claims, 3 Drawing Sheets

SCAVENGE GEAR PLATE FOR IMPROVED FLOW

INTRODUCTION

The present disclosure relates to an oil pump system for internal combustion engines in motor vehicles. More particularly, the present disclosure relates to gear plates for scavenge pump systems internal combustion engines in motor vehicles.

Certain internal combustion engines utilize a dry-sump system to manage the lubricating motor oil. The dry-sump system typically includes two or more oil pumps and a separate oil reservoir. For example, some internal combustion engines include a pressure pump and a scavenge pump. During the operation of the engine, oil falls to the base of the engine, where one or more scavenge pumps draw it away and transfer it to a reservoir, where it is stored before being recirculated through the engine by a pressure pump.

In many scavenge pump systems, multiple pumps discharge oil to a common manifold. The pumps may include, for example, spur gears and root style pumps.

Thus, while current scavenge pump systems achieve their intended purpose, there is a need for a new and improved system and method for scavenging oil from an internal combustion engine.

SUMMARY

According to several aspects, a pump includes a first gear plate and a first pair of counter rotating gears positioned on a first side of the gear plate. The pair of counter rotating gears draws fluid from an inlet and transfers the fluid into an outlet of a common manifold. The gear plate has a cutout to increase the flow of fluid into the common manifold.

In an additional aspect of the present disclosure, the pump further includes a second pair of counter rotating gears positioned on a second side of the gear plate, wherein each pair of counter rotating gears draws fluid from the inlet and pumps the fluid into the outlet.

In another aspect of the present disclosure, the pump further includes a plurality of pairs of counter rotating gears, a respective gear plate being positioned between adjacent pairs of counter rotating gears.

In another aspect of the present disclosure, the gear plate includes a first pocket positioned on the first side near the inlet to enhance the fluid flow from the inlet, and the gear plate includes a second pocket positioned on the second side near the inlet to enhance the fluid flow from the inlet.

In another aspect of the present disclosure, the gear plate includes a third pocket positioned on the first side near the common manifold to enhance the fluid as the gears mesh and force fluid into the common manifold, and the gear plate includes a fourth pocket positioned on the second side near the common manifold to enhance the fluid as the gears mesh and force fluid into the common manifold.

In another aspect of the present disclosure, the third pocket and the fourth pocket define a web with an arc and an offset on the cutout that minimizes stresses on the gear plate.

In another aspect of the present disclosure, the inlet is a low-pressure region and the outlet is a high-pressure region.

In another aspect of the present disclosure, the highest pressure occurs where the gears mesh, and the highest flow of fluid occurs when a tip of a tooth of one of the gears is near an outermost portion of the cutout.

According to several aspects, a pump includes a first gear plate, a first pair of counter rotating gears positioned on a first side of the gear plate, and a second pair of counter rotating gears positioned on a second side of the gear plate. Each pair of counter rotating gears draws fluid from an inlet and transfers the fluid into an outlet of a common manifold. The gear plate has a cutout to increase the flow of fluid into the common manifold.

In another aspect of the present disclosure, the pump further includes a plurality of counter rotating gears, a respective gear plate being positioned between adjacent pairs of counter rotating gears.

In another aspect of the present disclosure, wherein the gear plate includes a first pocket positioned on the first side near the inlet to enhance the fluid flow from the inlet, and the gear plate includes a second pocket positioned on the second side near the inlet to enhance the fluid flow from the inlet.

In another aspect of the present disclosure, the gear plate includes a third pocket positioned on the first side near the common manifold to enhance the fluid flow as the gears mesh and force fluid into the common manifold, and the gear plate includes a fourth pocket positioned on the second side near the common manifold to enhance the fluid flow as the gears mesh and force fluid into the common manifold.

In another aspect of the present disclosure, the third pocket and the fourth pocket define a web with an arc and an offset on the cutout that minimizes stresses on the gear plate.

In another aspect of the present disclosure, the inlet is a low-pressure region and the outlet is a high-pressure region.

In another aspect of the present disclosure, the highest pressure occurs where the gears mesh, and the highest flow of fluid occurs when a tip of a tooth of one of the gears is near an outermost portion of the cutout.

According to several aspects, a pump includes a plurality of gear plates and a plurality of pairs of counter rotating gears, a respective gear plate being positioned between adjacent pairs of counter rotating gears. Each pair of counter rotating gears draws fluid from an inlet and transfers the fluid into an outlet of a common manifold. Each gear plate has a cutout to increase the flow of fluid into the common manifold.

In another aspect of the present disclosure, each gear plate includes a first pocket positioned on a first side near the inlet to enhance the fluid flow from the inlet, a second pocket positioned on a second side near the inlet to enhance the fluid flow from the inlet, a third pocket positioned on the first side near the common manifold to enhance the fluid flow as the gears mesh and force fluid into the common manifold, and a fourth pocket positioned on the second side near the common manifold to enhance the fluid flow as the gears mesh and force fluid into the common manifold.

In another aspect of the present disclosure, the third pocket and the fourth pocket define a web with an arc and an offset on the cutout that minimizes stresses on the gear plate.

In another aspect of the present disclosure, the inlet is a low-pressure region and the outlet is a high-pressure region, and wherein the highest pressure occurs where the gears mesh, and the highest flow of fluid occurs when a tip of a tooth of one of the gears is near an outermost portion of the cutout.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
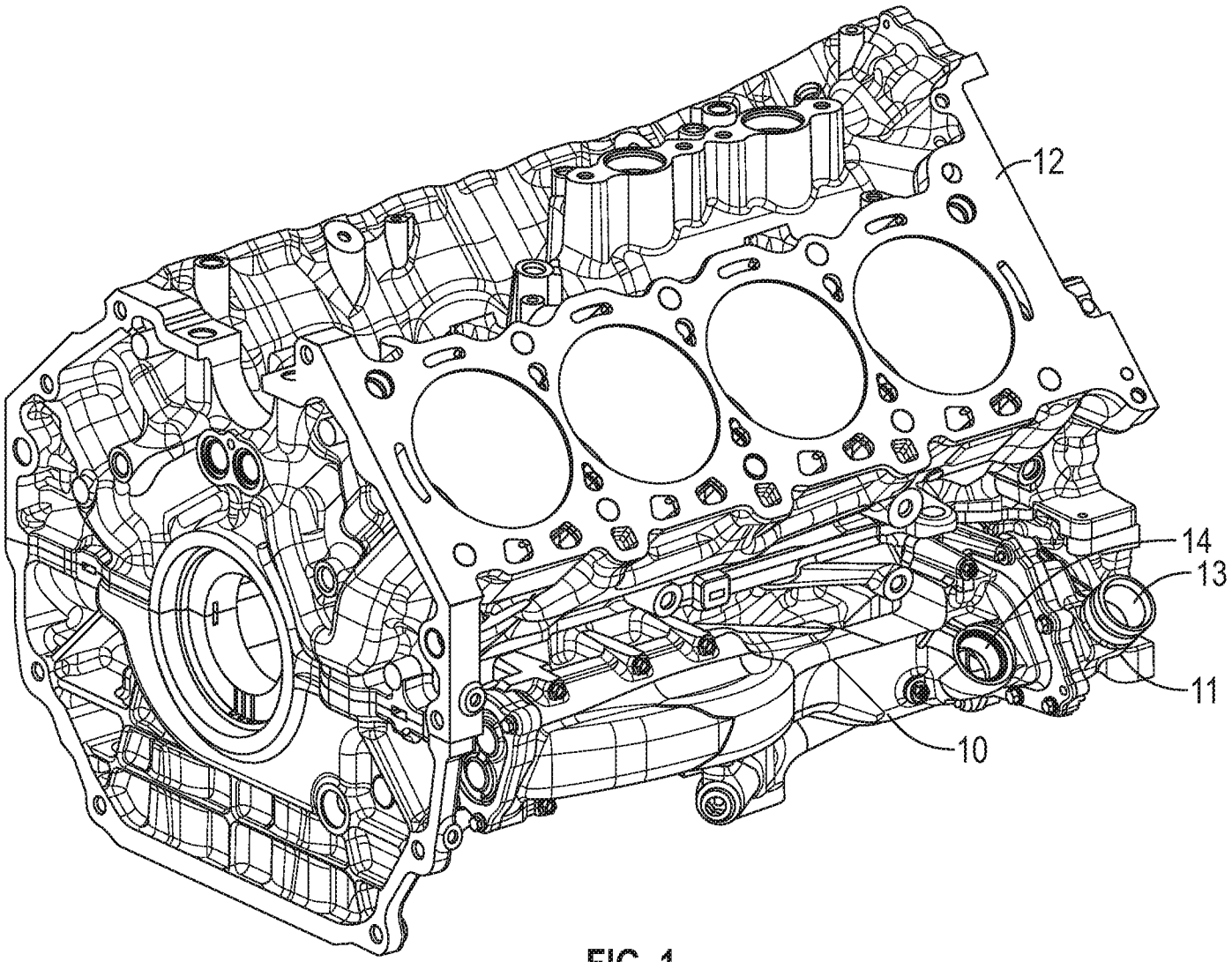
FIG. 1 is a perspective view of an engine block with a scavenge pump in accordance with an exemplary embodiment.

Referring to FIG. 1, there is shown an engine block 12 for a motor vehicle with a scavenge pump system 10. Oil is introduced to the engine block 12 via an inlet 13 of a variable vane pump 11. The scavenge pump system 10 draws oil from the engine block 12 and pumps the oil to an exit 14 from which oil is returned to a reservoir.

Figure 2:
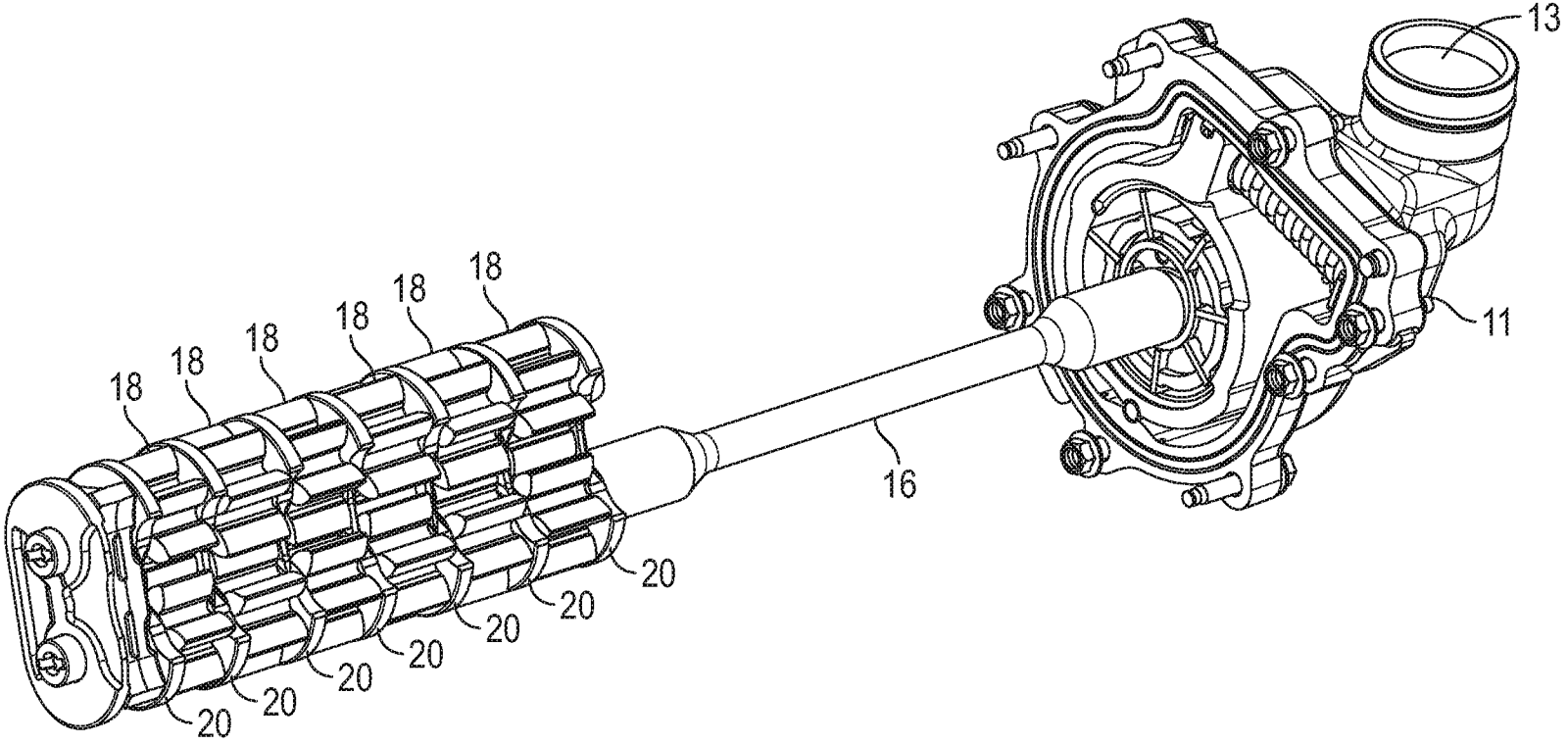
FIG. 2 is a perspective view on an interior of the scavenge pump in accordance with an exemplary embodiment.

Referring further to FIG. 2, the internal mechanisms of the scavenge pump system 10 are shown. Specifically, the scavenge pump system 10 includes a set of pumps 18 driven by a shaft 16. As shown, the scavenge pump system 10 includes six pumps 18. In some arrangements, however, the scavenge pump system 10 incudes fewer than six pumps, while in other arrangements, the scavenge pump system 10 includes more than six pumps. In various arrangements, a chain driven sprocket drives a shaft connected to the variable vane pump 11, which in turn drives the shaft 16.

Figure 3:
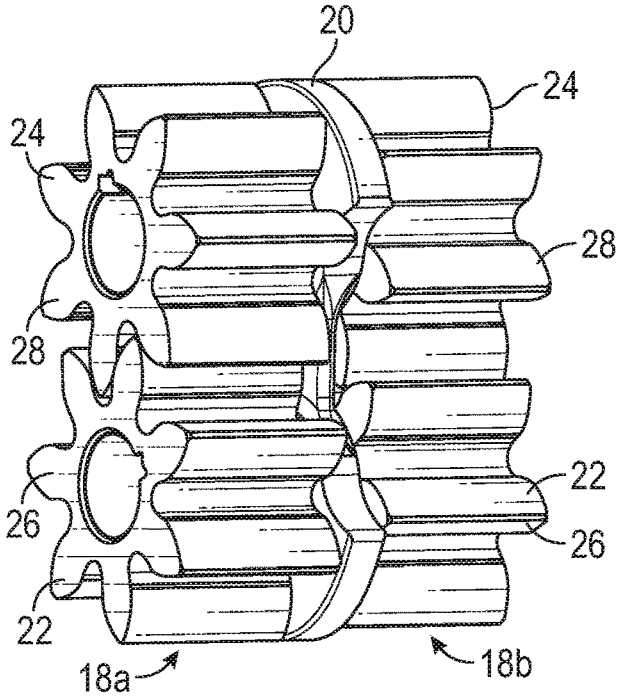
FIG. 3 is a perspective view of two pairs of counter rotating gears of the scavenge pump in accordance with an exemplary embodiment.

Positioned on each side of the pump 18 is a gear plate 20. Referring to FIG. 3, a pair of pumps 18*a* and 18*b* is shown. Each pump 18*a*, 18*b* includes a pair of counter rotating gears 22 and 24. The gear 22 includes a set of teeth 26, and the gear 24 include a set of teeth 28 that mesh with the set of teeth 26. In operation, the gears 22 and 24 counter rotate. For example, as shown in FIG. 5, the gear 24 rotates in a clockwise manner as indicated by the arrow 38, and the gear 22 rotates in a counterclockwise manner as indicated by the arrow 40.

Each pump 18 draws oil from a particular region of the engine block 12. As such, each pump 18 draws oil from an inlet 34 associated with the particular region of the engine block 12. The oil flows around the outer periphery of each gear 22 and 24 and exits the pump 18 into an outlet of a common manifold 36. The oil from each of the pumps 18 flows through the common manifold 36 of the scavenge pump system 10 to the exit 14. The oil then flows to a reservoir where the oil is momentarily staged and de-aerated and pumped back to the engine block 12 by the main feed pump.

Figure 4:
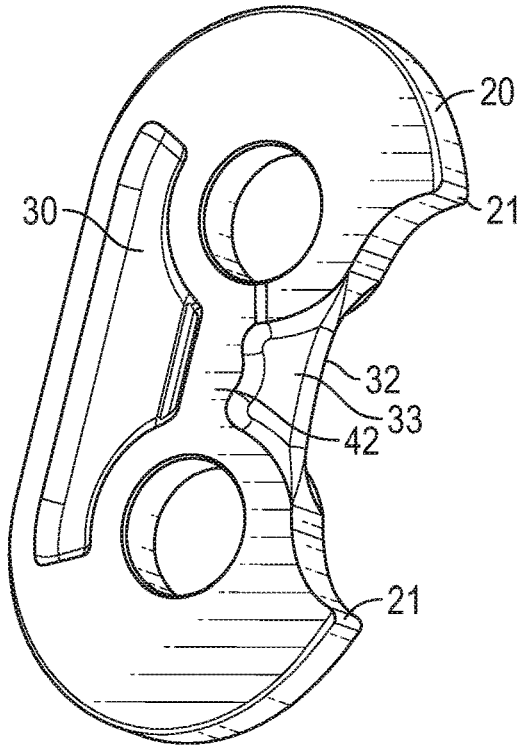
FIG. 4 is a perspective view of a gear plate positioned between the two pairs of counter rotating gears shown in FIG. 3 in accordance with an exemplary embodiment.

Referring also to FIG. 4, each gear plate 20 includes a cutout 32 with terminal regions 21. Each gear plate 20 also includes a first pocket 30 and a second pocket 33. The gear plates 20 provide sealing to the pumps 18 and pump porting. Note that any portion of the gear plate 20 extends into the flow path of the oil in the common manifold 36 generates a flow restriction. Accordingly, the cutout region 32 improves the flow of oil through the common manifold by reducing the gear rotation time of each gear 22 and 24 where oil is trapped within the gear meshing area. More specifically, without a cutout the oil leaves the pump 18 near the midsection of the gear plate 20. With the cutout 32, the oil leaves the pump 18 near the terminal regions 21 of the cutout 32, creating a less restrictive path and reducing pumping forces.

Figure 5:
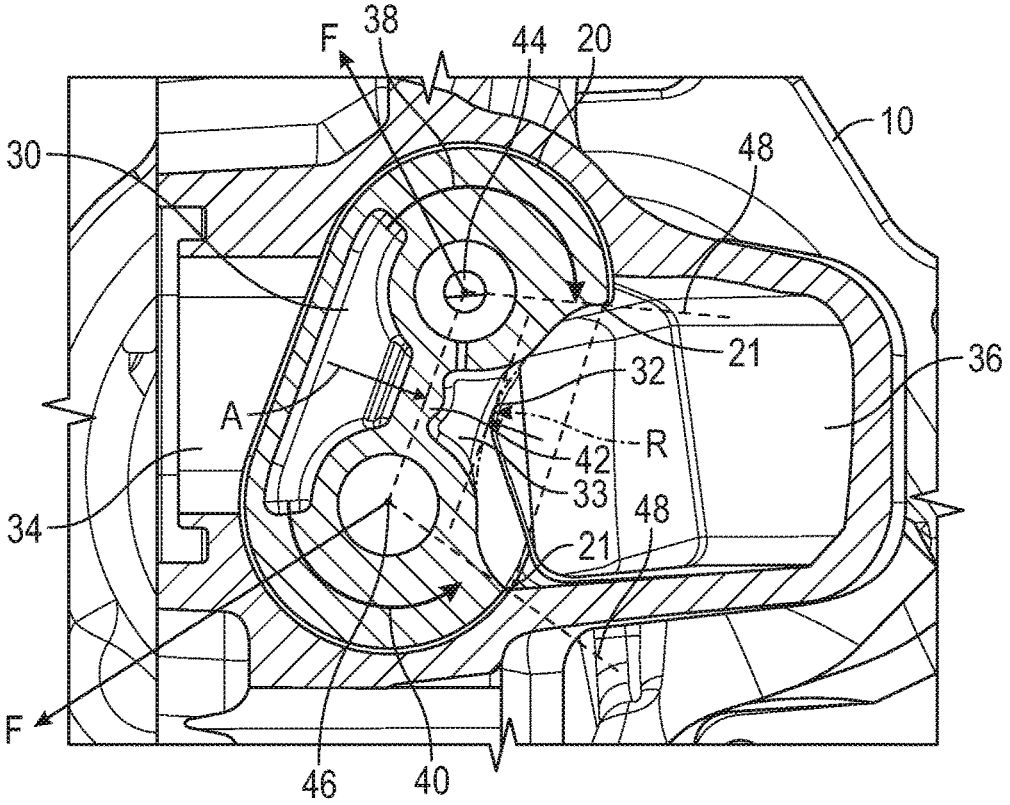
FIG. 5 is an end view of the gear plate positioned in the scavenge pump.

Referring further to FIG. 5, the inlets 34 of the scavenge pump system 10 are low-pressure regions, while the common manifold 36 is a high-pressure region. Also note that between adjacent pumps 18*a* and 18*b* (FIG. 3) the tip of the tooth 28 of pump 18*a* aligns with the valley between two teeth 28 of pump 18*b*. Similarly, the tip of the tip of the tooth 26 of pump 18*a* aligns with the valley between two teeth 26 of pump 18*b*. This offsetting of the gears 18 maximizes the sealing of each gear 18 near the terminal regions 21 of the cutouts 32. Further note that the pocket 30 enhances the flow of oil from the inlet 34 into the pump 18, and the pocket 33 enhances the flow of oil out of the pump 18 into the common manifold 36. A timing rib 42 of the gear plate 20 blocks communication from the high pressure side to the low pressure with minimal compressed volume. Note, in some arrangements, as the gears begin to mesh, the oil is compressed. The oil attempts to escape this high pressure area either radially past the space between the gear teeth, or via the side porting 33, but, Instead, the oil exits parallel to the shafts (side exit from the gears) where there is a cutout 32 in the gear plate 20, near a gear meshing point.

Further, the cutout 32 allows part of the gear plate 20 to act as part of the common manifold 36. The cutout 32 effectively increases the porting opening of the gears 22 and 24 near the terminal regions 21 to the rib 42. On the high pressure side of each pump 18, as the teeth of the gears 22 and 24 near the terminal regions 21, the cutout 32 acts as a local pressure relief as the oil exiting into the common manifold, which lowers oil compression power losses, as identified by the timing marks 48.

The gear plate 20 also incorporates additional features. The pockets 30 and 33 provide compactness to the gear plate 20, while the rib 42 provides rigidity and strength to the gear plate 20. As such, the thickness of the gear plate 20 can be minimized without compromising the structural integrity of the gear plate 20. For example, during the operation of the scavenge pump system 10, forces (F) are imparted on the gear plate 20 though shafts 44 and 46. These forces are a combination of the oil pressure and gear separation loads. Hence, the rib 42 and the web defined by the pocket 33 adds strength and rigidity to the gear plate 20. The distance between the centerline of the gears and the cutout is defined is identified by (A). This distance (A) is minimized to ensure maximum flow rate from the gear plate 20 while ensuring structural integrity of the gear plate, which results in a cutout 32 with a radius (R). Further note that the web defined by the pocket 33 transitions to a thicker portion of the gear plate 20 which relives stresses on the gear plate 20.

A scavenge pump system 10 of the present disclosure offers several advantages. These include, for example, lower oil aeration, lower pressure loss, lower power loss, and lower pressure pulsation in the common manifold 36. Further, the scavenge pump system 10 provides better packaging since the gear plates 30 act as part of the common manifold 36, which enables reducing the depth of the common manifold 36.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A pump comprising:

an inlet;

a common manifold comprising an outlet;

a first gear plate disposed between the inlet and the outlet, the first gear plate comprising:

a first side;

a second side disposed opposite the first side;

a peripheral surface surrounding the first side and the second side;

a first hole extending through the first side to the second side;

a second hole extending through the first side to the second side;

a timing rib disposed on the first side and extending from the first hole to the second hole;

a cutout adjacent the outlet and extending from the peripheral surface towards the timing rib, the cutout extending through the first gear plate and defining terminal ends extending towards the outlet;

a first pocket adjacent the inlet, the first pocket formed in the first side inwardly and separated from the peripheral surface and extending to the timing rib between the first hole and the second hole; and a second pocket adjacent the outlet, the second pocket formed in the first side and extending from the cutout to the timing rib;

a first pair of counter rotating gears supported for rotation within the first hole and the second hole of the first gear plate and positioned on the first side of the first gear plate; and a second pair of counter rotating gears supported for rotation within the first hole and the second hole of the first gear plate and positioned on the second side of the first gear plate, wherein the first pair of counter rotating gears draws a fluid from the inlet, compresses the fluid within intermeshing teeth of each of the first pair of the counter rotating gears, and transfers the fluid between the terminal ends of the cutout into the outlet of the common manifold.

2. The pump of claim 1, wherein the first gear plate includes a third pocket positioned on the second side adjacent the common manifold to enhance the fluid flow as the second pair of counter rotating gears mesh and force the fluid into the common manifold, and wherein the first gear plate includes a fourth pocket positioned on the second side adjacent the common manifold to enhance the fluid flow as the second pair of counter rotating gears mesh and force the fluid into the common manifold.

3. The pump of claim 1, wherein the inlet is a low-pressure region and the outlet is a high-pressure region.

4. The pump of claim 3, wherein a highest pressure occurs where the first pair of counter rotating gears mesh, and a highest flow of fluid occurs when a tip of a tooth of one of the first pair of counter rotating gears is near the terminal ends of the cutout.

5. The pump of claim 1, wherein the cutout overlaps the first and the second pairs of counter rotating gears to increase the flow of the fluid into the outlet.

6. The pump of claim 1, wherein the first pair of counter rotating gears rotate about axes extending through the first hole and the second hole, and the first pocket axially overlaps the first pair of counter rotating gears.

7. The pump of claim 6, wherein the second pocket axially overlaps the first pair of counter rotating gears.

8. The pump of claim 1, wherein the first pocket is entirely formed in the first side of the gear plate.

9. The pump of claim 1, further comprising a second gear plate disposed adjacent the first pair of counter-rotating gears and between the inlet and the outlet.

* * * * *